United States Patent [19]

Ferrari

[11] Patent Number: 4,574,107

[45] Date of Patent: Mar. 4, 1986

[54] METHOD OF PRODUCING A COATED FABRIC

[75] Inventor: Serge Ferrari, La Tour du Pin, France

[73] Assignee: Tissage et Enduction Serge Ferrari S.A., La Tour du Pin, France

[21] Appl. No.: 648,249

[22] Filed: Sep. 7, 1984

[30] Foreign Application Priority Data

Sep. 20, 1983 [FR] France ..... 83 15117

[51] Int. Cl.[4] ..... B05D 3/02; B32B 7/00; D04H 1/58; D04H 1/04

[52] U.S. Cl. ..... 428/259; 427/381; 427/389.9; 428/288; 428/296; 428/913

[58] Field of Search ..... 427/381, 389.9; 428/259, 296, 288, 913

[56] References Cited

U.S. PATENT DOCUMENTS 2,898,665 8/1959 Salem et al. ..... 28/28

FOREIGN PATENT DOCUMENTS 463461 10/1946 Belgium .
2109171 9/1972 Fed. Rep. of Germany .
1457488 11/1966 France .
737137 9/1955 United Kingdom .

*Primary Examiner*—Michael R. Lusignan
*Attorney, Agent, or Firm*—Parkhust & Oliff

[57] ABSTRACT

A method for producing a coated woven fabric, in which the support material comprises disintegrable chemical weft threads which are subsequently removed without the other threads being affected, method wherein:

a first support fabric is produced of which only part of the weft threads are disintegrable, and in a weave in which said disintegrable weft thread is so arranged that, were it to be removed, the result would be, not a woven fabric any longer, but a superposition of three criss-crossed layers of parallel warp threads, one layer of weft threads being squeezed between two layers of warp threads, respectively;

then, said support fabric is coated with a coating composition;

and finally, the deposited coating is gelled in the right temperature conditions to remove the disintegrable weft thread.

14 Claims, 3 Drawing Figures

METHOD OF PRODUCING A COATED FABRIC

The present invention relates to a method of producing a coated fabric and to the coated fabric obtained with said method.

In coated fabrics, and in particular coated fabrics used in the manufacture of tarpaulins for lorries and more particularly in the manufacture of sliding lateral shutters for lorries, what is essentially looked for is tear strength, especially in the case of incipient tears, since the tensile strength is always more than adequate.

Indeed, the basic support material, which is generally made of synthetic fibers, shows excellent tear strength properties. However, particularly in the case of incipient tears, it is a known fact that, after coating, that resistance is considerably diminished due, among other things, to the fact that the elementary yarns are locked in the new structure that results from the coating treatment. For example, the resistance to incipient tear often is reduced from fifty kilos and more for an unbleached support fabric to only 8 kilos after coating.

The solution most widely used in industry to overcome this consists in increasing the number of yarns or the size of those yarns, or both, and even in working them with special weaves such as "basket weaves", also known as "Panama". With such techniques, it is possible, in the best conditions, to double the resistance to incipient tear, but this is done by unnecessarily increasing the weight of the raw materials, which increases the price of the support, as well as the thickness and the overall weight of the fabric. In addition, the increase in tear strength which is obtained nevertheless remains insufficient.

It has also been proposed to use, instead of the woven fabrics, stitch-bonded fabrics such as those known as "Raschel" or "Malimo" fabrics. But although those techniques are efficient in improving tear strength, they remain little used industrially because the support fabrics are too expensive and too thick.

Similarly woven netting, namely of openwork fabrics, is not suitable as supports because it has a structure in which the yarns are not regularly positioned, so that an even and homogeneous coating is virtually impossible at an industrial level, at least for the present application.

In French Pat. No. FR-A-1,457,488, it has been suggested to use as support fabrics in which the warp is made up of permanent yarns alternating with disintegrable yarns which are partly eliminated during the coating process. It was possible with this particular technique to save on the textile fabric at a time when synthetic yarns were expensive. Regretfully, this technique has been found to improve the resistance to incipient tear of fabrics so coated only to a very small extent.

According to U.S. Pat. No. 2,898,665, a method has been proposed to produce a woven tire cord fabric in which a layer of parallel warp cords is very loosely interwoven with a disintegrable bonding thread, which is subsequently removed in conditions which do not affect the warp cords. Such removal is achieved either through heat or through dissolving, with in this last case subsequent removal of the solvent by heating. This method is not suitable for producing the canvas for tarpaulins, because the fabric being of loose structure, so that it cannot be properly coated, and even if it could, the disappearance of the weft threads would leave a layer of unidirectional warp cords, so that the resulting product would have a good tear strength weftwise, but none warpwise. In addition, the fact of removing the weft thread with heat could easily cause a retraction of those weft threads, which would affect the flatness of the warp layer, and would, in practice, make it impossible to obtain an even coating with a scraper.

It is the object of the present invention to overcome the aforesaid disadvantages by proposing a method of producing coated fabrics which is economical, easy to use and produces fabrics showing a very unexpectedly improved resistance to tearing and in particular resistance to incipient tears, without their other properties such as tensile strength being diminished, some of which properties, such as for example adhesiveness, are also improved as a result.

The method according to the invention for producing a coated woven fabric, in which the support contains disintegrable chemical weft threads, which are subsequently removed without the other threads being affected, consists essentially in:

first, producing a support fabric of which only part of the weft threads are disintegrable, in a weave in which said disintegrable weft thread is so arranged that, were it to be removed, the result would be, not a woven fabric any longer, but a superposition of three criss-crossed layers of parallel warp threads, one layer of weft threads being squeezed between two layers of warp threads, respectively;

then, in coating said support fabric with a coating composition;

and finally, in gelling the deposited coating composition under the right temperature conditions to disentegrate the disentegrable weft thread.

It is a known fact that the "weave" of a fabric designates the means of interlacing the warp threads with the weft threads. The rythym of a "weave" is the sequence of the threads which are picked and of the threads which are successively left in every pick. A technician will easily recognize the part where the disintegrable thread should be placed, so that once it is removed from the fabric, what is obtained is no longer a woven material, namely a fabric in which the warp threads and the weft threads are interlaced, but on the contrary a superposition of layers of parallel threads, which layers are criss-crossed, especially orthogonally, with, respectively and in that order, a first layer of parallel warp threads, in the middle, a second layer of parallel weft threads, orthogonal to the warp threads, and a third layer of warp threads parallel to the first, but whose threads are offset with respect to the threads of the first layer.

Advantageously:

the weave is a "taffeta weave" (also called "plain weave" or "canvas") and the disintegrable thread is woven every alternate row;

the weave is a basket weave (also called "national weave" or "Panama weave") and two disintegrable threads are woven as a pair, every alternate row;

the disintegrable thread is removed by melting or by decomposition when the coating is applied and more precisely during gelling;

the disintegrable thread is made of chlorofibers and the coating composition is a plastisol of polyvinyl chloride (PVC) applied, for example, with a scraper;

the support fabric coated with the coating layer, while being firmly stretched crosswise in order to prevent the chlorofibers from withdrawing, is first pregelled to prevent that withdrawal, and then, still kept stretched crosswise, and after another coating on both sides, is gelled under temperature conditions adequate to cause the chlorofibers to melt and thus to cause them to disappear in the PVC coating layer;

a pregelation is carried out for 6 to 40 seconds at around 130° C.;

the support fabric is a closely woven fabric.

In other words, the invention mainly consists:

first, in coating in known manner a fabric of special texture, comprising a weft partly composed of suitably arranged disintegrable threads, and then in gelling the deposited coating layer in conditions capable of causing the disintegrable weft threads to melt; so that, after coating, the textile support is no longer a fabric, but a superposition of layers of parallel threads, superposed in criss-crossed relation.

Thus, to all the advantages brought by coating a closely woven fabric are added the advantages inherent in structures composed of layers of parallel threads, in the manner of a perforated grid of which the threads stay in the same position.

Since the coating layer is deposited on a closely woven fabric, it is possible to obtain a regular and homogeneous coating. It also results in a final assembly in which the threads are free to move with respect to one another without being sealed by the texture of the initial weave, which, in reality, has completely disappeared. This new structure of criss-crossed layers of parallel threads provides of tear strength and in particular incipient tear strength properties which are greatly improved, and this in proportions which were completely unforeseeable and therefore totally unexpected.

As already indicated hereinabove, the disintegrable thread is advantageously of the same chemical nature as the coating. A PVC coating can be used with chlorofibers, and polyamide coatings can be used with copolyamide threads of low melting point. Polypropylene or, better still, polyethylene threads of low melting point are advantageously used with coatings based on polyolefin.

The disintegrable weft thread may be mono-or multifilament, or even made of spun fiber yarns. Advantageously, second-grade threads are used to reduce the cost. The count of the disintegrable thread is as fine as possible, while remaining compatible with good working of the looms.

The invention will be more readily understood on reading the following description with reference to the accompanying drawings in which.

In said Figures.

Figure 1:
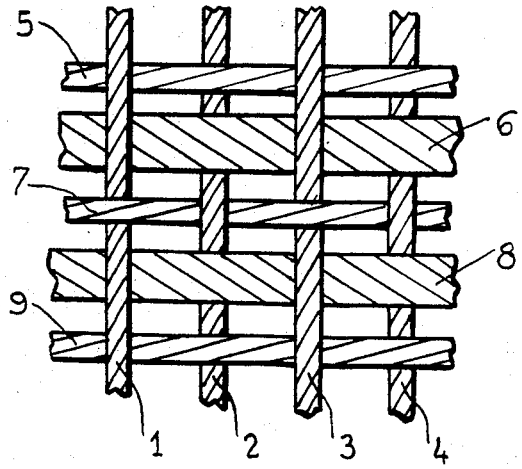
FIG. 1 shows the weave of a woven support fabric according to the invention.

references (1,2,3 and 4) designate the successive warp threads;

references (5,7 and 9) designate the disintegrable weft threads;

references (6 and 8) designate permanent weft to threads, i.e., non-disintegrable threads;

reference (10) designates the coating layer.

EXAMPLE 1

A coated fabric is produced according to the conventionally known method such as explained hereinabove, which fabric has the following characteristics:

weave: two-thread basket weave structure (Panama);

warp: 12 threads per centimetre of polyester 1100 dtex/192 filaments twisted at 130 twists per meter;

weft: 12 threads per centimetre of a polyester, woven two-by-two, in polyester of 1100 dtex/192 filaments with no twist;

weaving in width of 185 cm, so that, after coating and stamping of selvedges, a serviceable width of 180 cm is obtained, this resulting into no weft shrinkage;

weight of the basic material: about 300 g/m$^2$;

coating: PVC plastisol deposited in several operations in the conditions described in French Pat. No. FR-A-2,245,165 of one of the co-applicants (and corresponding to U.S. Pat. No. 4,052,521); deposited weight: 550 g/m$^2$, with continuous weft tension, pregelling for thirty seconds at 130° C. and gelling for one minute at 180° C.

This fabric shows the following properties:

weight: 850 g/m$^2$;

tensile strength (breaking measured on 5 cm wide strips): 450 kg warpwise and weftwise;

resistance to incipient tear (Norm AFNOR G 07.055, according to method C): 15 kg;

adhesiveness (stripping force on two 5 cm wide strips, bonded together): 10 kg.

EXAMPLE 2

Example 1 is repeated but for one variation which is that weftwise the structure is changed to 12 threads per cm in groups of two in the shed at the rate of two polyester threads 2200 dtex/420 filaments with no twist and two spun yarns of chlorofibers, metric count 2/40. Thus, the weft is composed of, successively, two spun yarns of chlorofibers, followed by a group of two polyester threads.

Under heat, the chlorofibers, which have a tendency to shrink, cannot do so due to the weft tension which is applied during pre-gelation as well as during gelation. These threads are decomposed at between 175° and 180° C.

After coating, a fabric is obtained which has the following characteristics:

weight: 830 g/m$^2$ warp strength: 450 kg.

weft strength: 450 kg, incipient tear and incipient break strength in excess of 50 kg, which is the maximum limit of the tear tester used, adhesiveness: 20 kg.

In practice, during incipient tear tests or adhesiveness tests a certain delamination is observed after a certain time, but no tearing. This clearly proves that the coating has gone through to both sides of the textile support.

EXAMPLE 3

A taffeta weave is produced which contains:

for the warp: nine threads per centimeter (1,2,3,4) of polyester: 1100 dtex/192 filaments twisted at the rate of 130 twists/dtex meter;

for the weft: nine threads per centimeter, namely, respectively and in the order indicated:

one thread of polyester (6,8) of 2200 dtex/420 filaments, with no twist.

one thread of chlorofiber (5,7,9) RHOVYL (Trademark filed by Rhone-Poulenc Fibres) formed by the twisting of two initial ends, metric count 40.

The 185 cm wide unbleached fabric weighs 210 g/m$^2$.

A plastisol of PVC is coated in the same conditions as used in Example 1, care being taken to deposit first an undercoating of about 100 g/m$^2$ on each side of the fabric, finishing with a coating of the same composition of plastisol over the abrasion layer. As indicated in Example 1, the fabric is kept under weft tension throughout the entire coating treatment.

The finished fabric weighs 680 g/m$^2$ and, after stamping of the selvedges, its width is 180 cm, this proving that there has been virtually no shrinkage of the weft.

Tensile strength of this fabric is 300 kg weftwise, and 300 kg warpwise.

Resistance to incipient tear one measured in the same conditions and found to be over 50 kg, which is the maximum limit of the tear tester used.

Adhesiveness, again measured on strips of 5 cm, was 20 kg.

Figure 2:
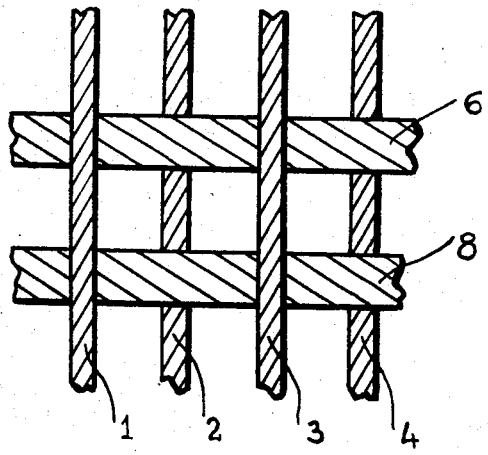
FIG. 2 shows the structure of said fabric after coating and removal of the disintegrable threads.
Figure 3:
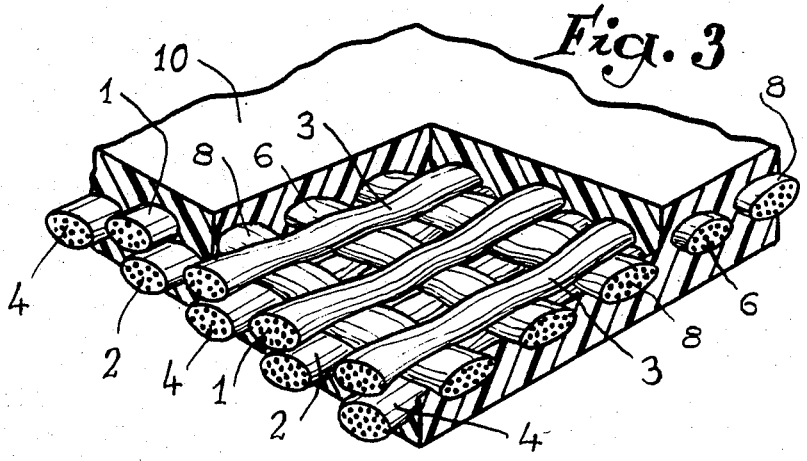
FIG. 3 shows a perspective view in partial cross-section of a coated fabric for use as a tarpaulin and produced according to the invention.

It also is observed (see FIGS. 2 and 3) that the initially woven textile support is transformed after the coating treatment, which results in the disappearance of the chlorofibers (5,7,9), to become a superposition of layers of parallel polyester threads, namely, respectively:

a first layer of warp threads (2,4)

a second layer of weft threads (6,8) perpendicular to the first layer (2,4), a third layer of warp threads (1,3) parallel to the first layer (2,4) but of which the threads are offset with respect to the threads (2,4) of the first layer;

the result is embedded in a regular and homogeneous coating layer (10).

The finished product shows a definitely unexpected improvement since, all the other properties being preserved, the resistance to incipient tear is more than trebled.

EXAMPLE 4

The preceding example is repeated except that the disintegrable weft threads of chlorofibers are replaced by polyester threads of the same thickness and with the same characteristics as the other weft threads, namely polyester 1100 dtex/192 strands with no twist.

The resulting fabric weighs about 700 g/m$^2$, is 180 cm wide, and has a tensile strength of 300 kg weftwise and warpwise, but its resistance to incipient tear is only of 8 kg (against 50 kg) and its adhesiveness of 10 kg (against 20).

This illustrates perfectly the totally unexpected improvement obtained with the method according to the invention.

EXAMPLE 5

The procedure is the same as in Example 4, except that every other warp thread is in chlorofibers, as described in French Pat. No. 1,457,488 cited hereinabove.

During the hot-coating treatment, the chlorofiber warp threads retract instantly when introduced into the oven. This leads to the defect known as "shiners", and results in considerable slurpgalling in the warp; which in turn makes coating virtually impossible to use at industrial level.

The fabrics produced according to the invention are essentially characterized by a tear strength and in particular in incipient tear strength which is considerably improved, so that said fabrics can be used advantageously for producing the sliding covers of tarpaulins used in lorries, the canvases for containers, silos, conveyor belts, canvases to be cut into belts, or canvases for inflatable structures.

What we claim is:

1. An improved method of producing a coated fabric, in which the support material comprises disintegrable chemical weft threads which are subsequently removed during the coating step without the other threads being affected, the method comprising:

producing a woven support fabric in which some of the weft threads are disintegrable, said disintegrable weft threads being so arranged in said fabric that, were they to be removed, the result would no longer be a woven fabric, but a superposition of three orthogonally criss-crossed layers of parallel threads comprised of one layer of weft threads squeezed between two layers of warp threads;

coating said woven support fabric with a coating composition of substantially the same chemical composition as the disintegrable threads;

and gelling the deposited coating under temperature conditions which will melt said disintegrable weft threads and cause them to fuse with the coating.

2. A method as claimed in claim 1, wherein the weave of the fabric is a taffeta weave, and the disintegrable weft thread in the weave is alternate.

3. A method as claimed in claim 1, wherein the weave of the fabric is a basket weave and the disintegrable weft threads are woven two at a time in the shed, in alternate manner.

4. A method as claimed in claim 1, wherein the disintegrable weft threads are comprised of chlorofibers, and the coating composition is comprised of a polyvinyl chloride plastisol (PVC).

5. A method as claimed in claim 4, wherein the fabric coated with the coating layer, being firmly kept under weft tension, is first pre-gelled to prevent the withdrawal of the chlorofibers, and then gelled under temperature conditions that are adequate to cause the chlorofibers to melt, thus causing them to fuse with the PVC coating layer.

6. Method as claimed in claim 5, wherein pregelling is conducted for 10 to 40 seconds at 130° C., and in continuous manner and still under weft tension, gelling is conducted for 40 to 90 seconds at 180° C.

7. A method for producing a coated fabric, comprising:

producing a plurality of weft threads comprised of a disintegrable material;

producing a plurality of weft threads comprised of a non-disintegrable material;

producing a plurality of warp threads comprised of a non-disintegrable material;

weaving a support fabric from said warp and weft threads wherein said disintegrable weft threads are interspersed among said non-disintegrable weft threads such that, if said disintegrable weft threads were removed:

(a) said warp threads would be disposed substantially in parallel in two substantially parallel layers, but with the threads in one layer laterally shifted relative to the threads in the other layer; and (b) said non-disintegrable weft threads would be disposed substantially in parallel in a middle layer pressed between the two layers of warp threads, with the weft threads substantially orthogonal to the warp threads;

coating said support fabric with a coating composition comprised of substantially the same material as said disintegrable weft threads;

heating the coated support fabric at a temperature which will melt said disintegrable weft threads, fuse the coating composition and melted threads together, and gel the fused coating composition and melted threads.

8. A method as claimed in claim 7, wherein the support fabric is woven in a taffeta weave, with the disintegrable weft threads alternating with the non-disintegrable weft threads.

9. A method as claimed in claim 7, wherein the support fabric is woven in a basket weave, with a non-disintegrable weft thread and a disintegrable weft thread woven as a pair alternating with a single disintegrable weft thread.

10. A method as claimed in claim 7, wherein said disintegrable weft threads comprise chlorofibers, and said coating composition comprises a polyvinyl chloride plastisol, wherein the fabric is placed under tension in the weft direction prior to said coating step, and wherein the heating step comprises:

heating the coated fabric for about 10 to 40 seconds at about 130° C. to pre-gel it;

heating the coated fabric for about 40 to 90 seconds at about 180° C. to melt the disintegrable weft threads, and fuse and gel the melted weft threads and coating composition.

11. A coated material produced according to the process comprising:

producing a plurality of weft threads comprised of a disintegrable material;

producing a plurality of weft threads comprised of a non-disintegrable material;

producing a plurality of warp threads comprised of a non-disintegrable material;

weaving a support fabric from said warp and weft threads wherein said disintegrable weft threads are interspersed among said non-disintegrable weft threads such that, if said disintegrable weft threads were removed:

(a) said warp threads would be disposed substantially in parallel in two substantially parallel layers, but with the threads in one layer laterally shifted relative to the threads in the other layer; and (b) said non-disintegrable weft threads would be disposed substantially in parallel in a middle layer pressed between the two layers of warp threads, with the weft threads substantially orthogonal to the warp threads;

coating said support fabric with a coating composition comprised of substantially the same material as said disintegrable weft threads;

heating the coated support fabric at a temperature which will melt said disintegrable weft threads, fuse the coating composition and melted threads together, and gel the fused coating composition and melted threads.

12. Coated material as claimed in claim 11, wherein the support fabric is woven in a taffeta weave, with the disintegrable weft threads alternating with the non-disintegrable weft threads.

13. Coated material as claimed in claim 11, wherein the support fabric is woven in a basket weave, with a non-disintegrable weft thread and a disintegrable weft thread woven as a pair alternating with a single disintegrable weft thread.

14. Coated material as claimed in claim 11, wherein said disintegrable weft threads comprise chlorofibers, and said coating composition comprises a polyvinyl chloride plastisol, wherein the fabric is placed under tension in the weft direction prior to said coating step, and wherein the heating step comprises:

heating the coated fabric for about 10 to 40 seconds at about 130° C. to pre-gel it;

heating the coated fabric for about 40 to 90 seconds at about 180° C. to melt the disintegrable weft threads, and fuse and gel the melted weft threads and coating composition.

* * * * *